US005435276A

United States Patent [19]

Nakamura et al.

[11] Patent Number: 5,435,276

[45] Date of Patent: Jul. 25, 1995

[54] ENGINE CAM CHANGE-OVER MECHANISM

[75] Inventors: Makoto Nakamura, Yokosuka; Siniti Takemura, Chigasaki; Teturou Goto, Yokosuka; Shoji Morita; Yukio Yamakawa, both of Atsugi, all of Japan

[73] Assignees: Nissan Motor Co., Ltd., Yokohama; Kabushiki Kaisha Unisia Jecs, Atsugi, both of Japan

[21] Appl. No.: 132,285

[22] Filed: Oct. 6, 1993

[30] Foreign Application Priority Data

Oct. 9, 1992 [JP] Japan ..... 4-272022

[51] Int. Cl.[6] ..... F01L 1/34; F01L 1/18

[52] U.S. Cl. ..... 123/90.16; 123/90.4; 74/559

[58] Field of Search ..... 123/90.15, 90.16, 90.17, 123/90.22, 90.27, 90.39, 90.4; 74/568 R, 567, 569, 559

[56] References Cited

U.S. PATENT DOCUMENTS

| | | | |
|---|---|---|---|
| 4,203,397 | 5/1980 | Soeters, Jr. | 123/90.16 |
| 5,046,462 | 9/1991 | Matayoshi et al. | 123/90.16 |
| 5,080,054 | 1/1992 | Nakamura | 123/90.16 |
| 5,183,015 | 2/1993 | Morita et al. | 123/90.16 |
| 5,239,952 | 8/1993 | Morita | 123/90.16 |
| 5,297,516 | 3/1994 | Hara | 123/90.16 |
| 5,301,636 | 4/1991 | Nakamura | 123/90.16 |
| 5,333,579 | 8/1994 | Hara et al. | 123/90.17 |
| 5,347,962 | 9/1994 | Nakamura et al. | 123/90.16 |

FOREIGN PATENT DOCUMENTS

| | | |
|---|---|---|
| 63-57805 | 3/1988 | Japan . |
| 63-167016 | 7/1988 | Japan . |

*Primary Examiner*—Henry C. Yuen
*Assistant Examiner*—Weilun Lo
*Attorney, Agent, or Firm*—Foley & Lardner

[57] ABSTRACT

A main rocker arm driven by a first cam, and a sub-rocker arm driven by a second cam larger than the first cam, are supported adjacent to each other. A sliding member which moves together with the sub-rocker arm, and a contact piece which comes into contact with the sliding member according to the slide position of the sliding member, are provided on the main rocker arm. The sliding member moves between a position where it is in contact with the contact piece and a position where it is not in contact with the contact piece according to the engine running conditions. The sliding member and contact member are constructed of iron or an iron alloy, while the main rocker arm is constructed of aluminum or an aluminum alloy. The construction of the cam change-over mechanism is therefore rendered light-weight, and machining of the main rocker arm is rendered facile.

6 Claims, 7 Drawing Sheets

ENGINE CAM CHANGE-OVER MECHANISM

FIELD OF THE INVENTION

This invention relates to am engine wherein a plurality of cams may be selected according to engine running conditions, and more specifically, to a cam change-over mechanism provided in such an engine.

BACKGROUND OF THE INVENTION

In an automobile engine, in order to achieve the dual objectives of improved torque at low or medium running speeds and improved output at high running speeds, a plurality of cams are used selectively according to the engine running conditions. By using cams of different shapes, the lift properties of an intake valve and an exhaust valve are varied. In this way, the timing with which air is taken into and exhaust gas is expelled from the engine, and the air intake and exhaust gas volume, are controlled.

A cam change-over mechanism for such an engine is described for example in Japanese Tokkai Sho 63-167016 and Tokkai Sho 63-57805 published by the Japanese Patent Office.

In this change-over mechanism, a low speed rocker arm and high speed rocker arm are supported adjacent to each other on a common rocker shaft such that they are free to oscillate independently of each other, the end of the low speed rocker arm being in contact with the intake valve or exhaust valve. A low speed cam slides on the low speed rocker arm, and a high speed cam slides on the high speed rocker arm. The high speed rocker arm has a shape corresponding to a longer valve opening time or larger valve lift than the low speed cam.

Engaging holes parallel to the rocker shaft are formed in both rocker arms at a predetermined distance from the shaft, a plunger being inserted in one of these holes.

This plunger is driven by oil pressure. When the low speed and high speed rocker arms come to a predetermined rotational position relative to one another, the plunger is pushed out into ,.the engaging hole in the adjacent rocker arm so that the two rocker arms lock together. The valve then opens and closes according to the characteristics of the high speed cam. When the plunger withdraws from the hole in the rocker arm, the two rocker arms are released, and the valve opens and closes according to the characteristics of the low speed cam.

In this cam change-over mechanism, however, the engaging holes in the rocker arms must be arranged coaxially when the plunger moves. The plunger and the engaging holes therefore have to be machined with extremely high precision so that locking and release of the rocker arms is smooth. As a result, the machining of these parts is difficult and costly.

Further, to maintain the anti-wear properties of the engaging parts, an iron alloy is generally used to manufacture them. This however increases the inertial mass of the valve drive mechanism, and impairs the response of the valve in response to the action of the cams in the high engine speed region.

SUMMARY OF THE INVENTION

It is therefore an object of this invention to provide a cam change-over mechanism which does not require high precision manufacture.

It is a further object of this invention to enable a cam change-over mechanism to be made more lightweight.

In order to achieve the aforesaid objects, this invention provides a cam change-over mechanism for an engine having an intake valve, exhaust valve, first cam which opens and closes one of these valves, mid second cam of larger size than the first cam which opens and closes the same valve. This cam change-over mechanism comprises a main rocker shaft supported by an engine, main rocker arm supported free to oscillate on the main rocker shaft, and which is made to oscillate by the first cam so as to transmit the motion of the first cam to the aforesaid valve, a sub-rocker shaft supported parallel to the main rocker shaft by the main rocker arm, a sub-rocker arm supported by the sub-rocker shaft such that it is free to oscillate, a mechanism which retains the sub-rocker arm in elastic contact with the second cam, a sliding member which is provided on the sub-rocker arm and slides parallel to the sub-rocker shaft, a contact member in contact with the sliding member at a predetermined position, and a mechanism supported on the main rocker arm which drives the sliding member between a position wherein it is in contact with the contact member and a position wherein it is not in contact with the contact member.

By driving the sliding member between the contact position and non-contact position, the main rocker arm and sub-rocker arm are engaged or disengaged. The sliding mechanism does not engage with the sub-rocker arm, but the contact of the sliding member with the contact member causes the sub-rocker arm and main rocker arm to engage. There is therefore no need to provide engaging holes in the rocker arms, and machining of the rocker arms is rendered easier.

Further, by manufacturing the sliding member and contact member of iron or an iron alloy and manufacturing the main rocker arm of aluminum or an aluminum alloy, a lightweight cam change-over mechanism is obtained.

By forming the contact member to have a cylindrical shape, and by making it screw into a screw hole formed in the main rocker arm, locking strength between the contact member mad main rocker arm is increased. By rotating the contact member, the relative rotational positions of the main rocker arm and sub-rocker arm are changed, and the cam clearance can be finely adjusted.

The elastic retaining mechanism preferably comprises a spring in the main rocker arm, and a member supported by this spring in contact with the sliding member in its non-contact position. By housing this mechanism inside the contact member, the cam change-over mechanism can be made even more compact.

The drive mechanism preferably comprises a plunger housed in the main rocker shaft free to slide parallel to the sub-rocker shaft, a spring which holds the sliding member in contact with the plunger, and a hydraulic means which slides the plunger. With this construction the cam change-over can be performed by hydraulic control.

Further, by supplying oil via an oil chamber formed in the main rocker arm, a working oil passage formed in the main rocker shaft and a throughhole formed in the main rocker arm connecting the working oil passage and oil chamber, off pressure can be supplied to the drive mechanism without the need for an external oil pressure pipe.

The details as well as other features and advantages of this invention are set forth in the remainder of the specification and are shown in the accompanying drawings.

DESCRIPTION OF THE PREFERRED EMBODIMENTS

Figure 1:
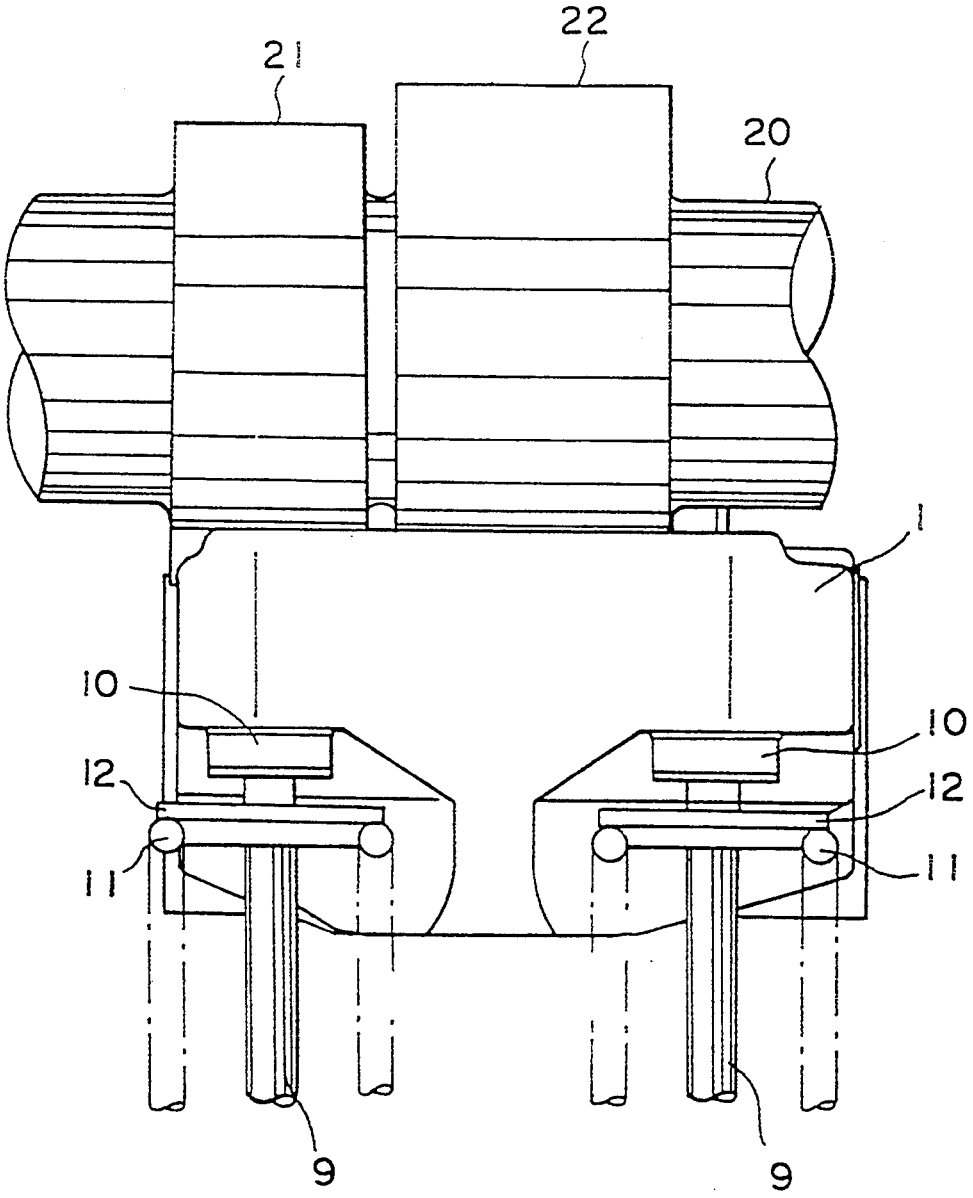
FIG. 1 is a side elevation of a cam change-over mechanism according to this invention.
Figure 4:
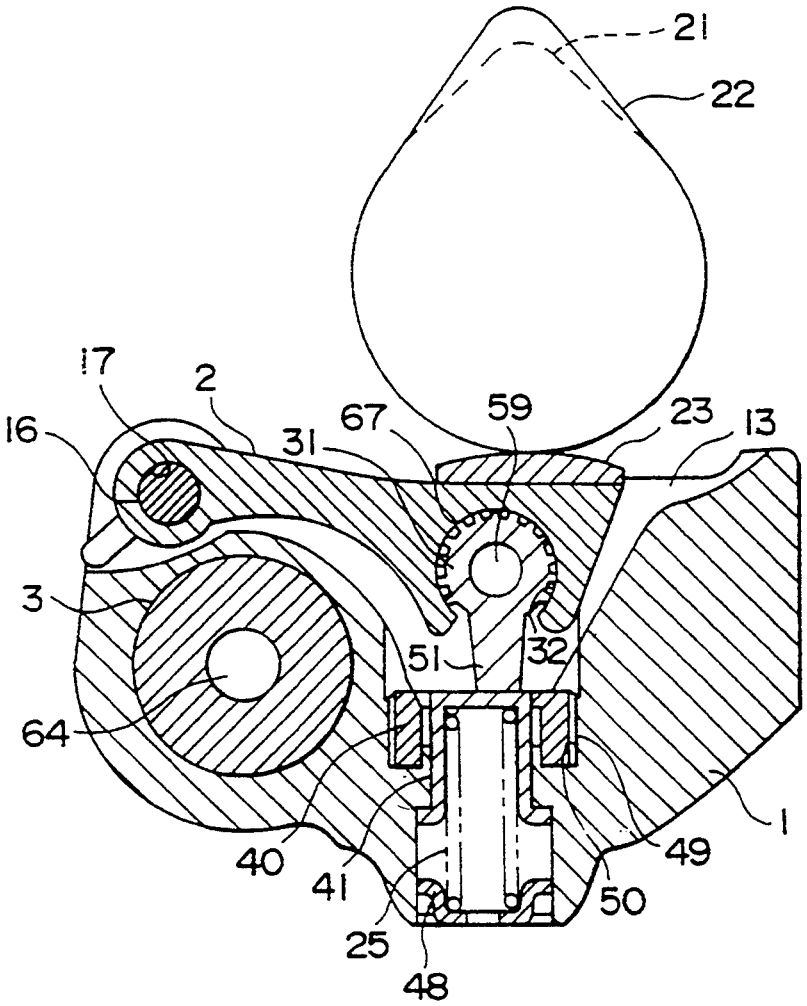
FIG. 4 is a sectional view through the cam change-over mechanism along a line 4—4 of FIG. 2.

Referring to FIG. 1 of the drawings, a cylinder of an automobile engine is provided with two intake valves 9, a first cam 21 for low speed and a second cam 22 for high speed being formed in a one-piece construction on a cam shaft 20 so as to open and close the intake valves 9. The cam shaft 20 is common to all engine cylinders, and there are cams 21 and 22 formed on the shaft 20 for each cylinder. The first cam 21 and second cam 22 have different forms (including similar shapes of different size) in order to satisfy the valve lift characteristics required for low engine speed and high engine speed, and the second cam 22 has a shape such that either a valve lift amount or a valve opening time, or both, are greater than in the case of the first cam 21. In the present case, both the valve lift amount and the opening period are increased as shown in FIG. 4.

A single main rocker arm 1 is provided in each cylinder for driving the two intake valves 9. A main rocker shaft 3 common to all the cylinders is supported free to oscillate at the base of the main rocker arm 1.

A chip 10 in contact with the stem tip of each intake valve 9 is fixed on each end of the main rocker arm 1. A retainer 12 is fixed on the stem of each valve 9, and a valve spring 11 exerts a force on the valve 9 via this retainer 12 in a direction tending to close the valve corresponding to the upwards direction in the figure.

Figure 3:
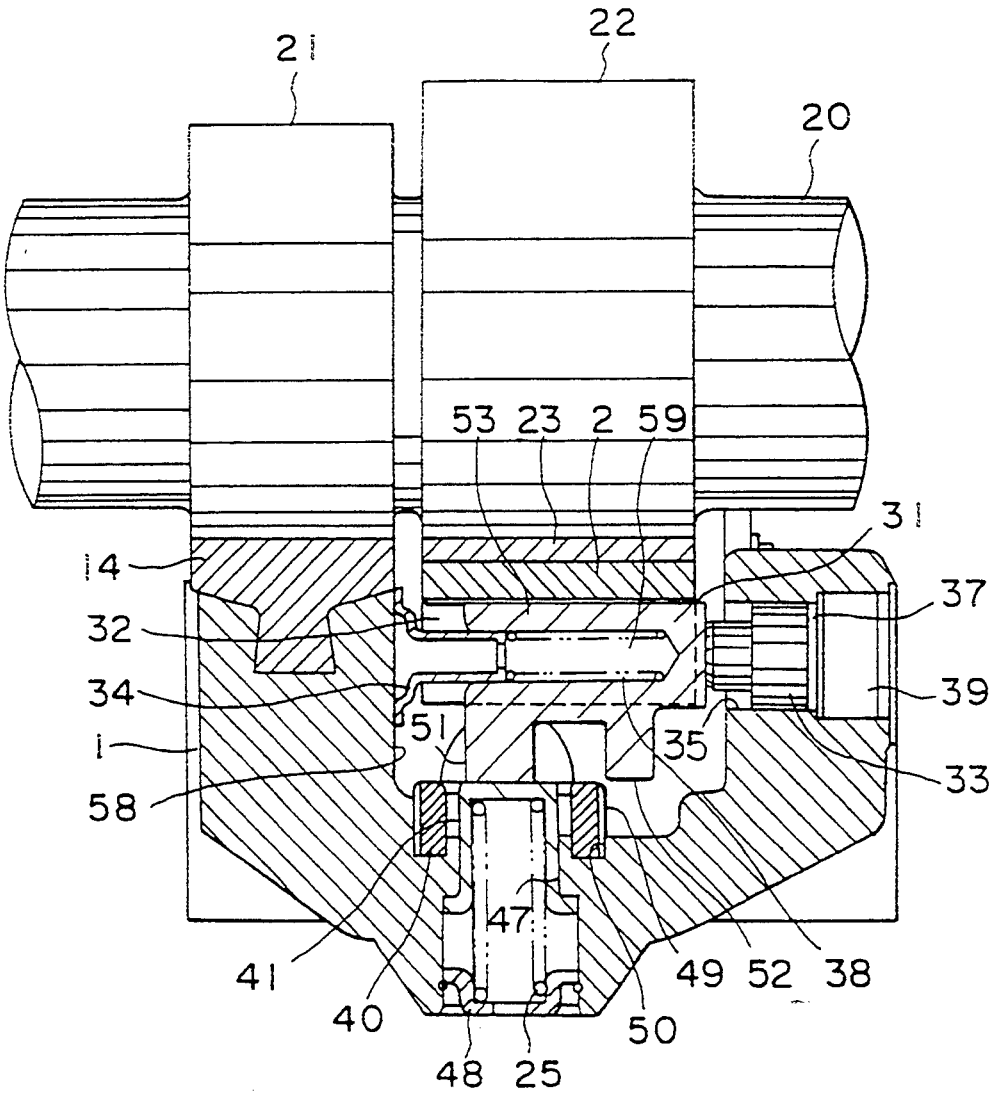
FIG. 3 is a sectional view through the cam change-over mechanism along a line 3—3 of FIG. 2.

A cam follower 14 consisting of an iron alloy is fixed on the main rocker arm 1 in sliding contact with the first cam 21 as shown in FIG. 3. In this position of the main rocker arm 1, a roller follower may also be supported in contact with the first cam 21 via a bearing instead of the cam follower 14.

Figure 2:
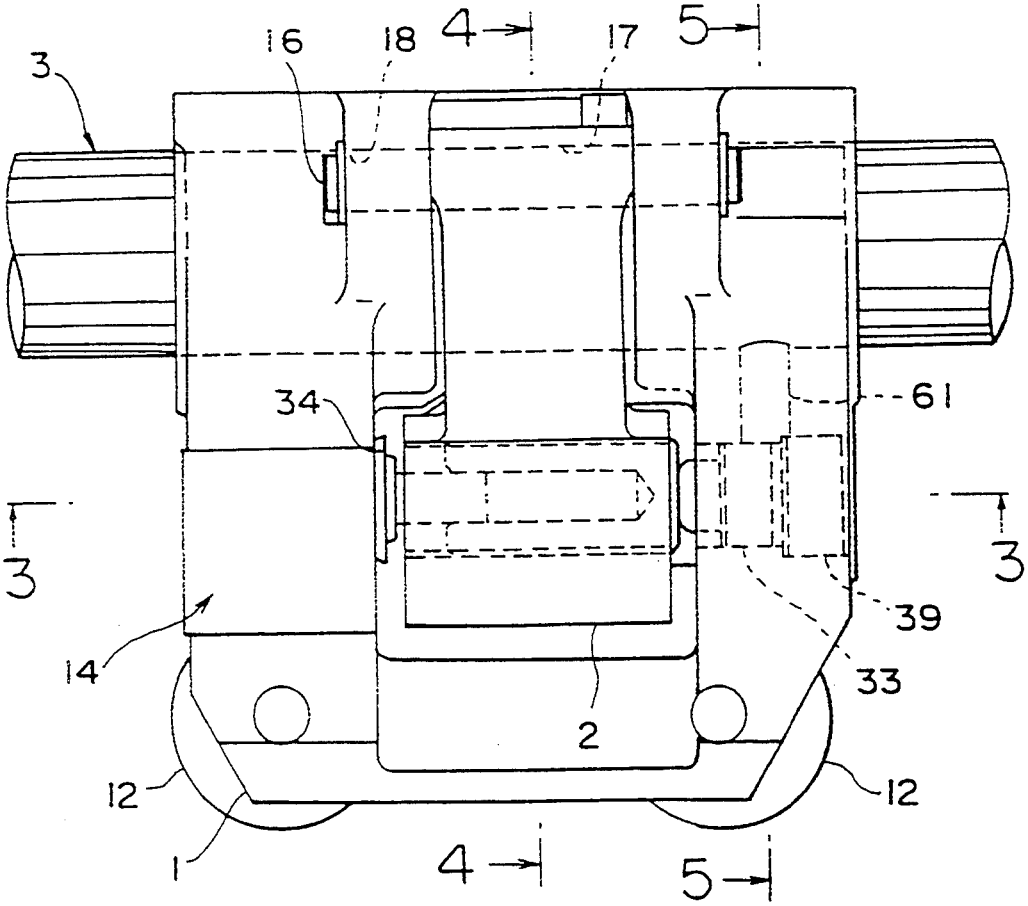
FIG. 2 is a plan view of the cam change-over mechanism.

The main rocker arm 1 has an approximately rectangular flat shape as shown in FIG. 2. A sub-rocker arm 2 is supported on the main rocker arm 1 alongside the cam follower 14. The sub-rocker arm 2 is housed in a hollow 13 formed in the central part of the main rocker arm 1.

An end of the sub-rocker arm 2 is connected via a sub-rocker shaft 16 to the main rocker arm 1 such that it can rotate relative to it. The sub-rocker shaft 16 engages such that it is free to slide in a hole 17 formed in the sub-rocker arm 2, its two ends being pressed in a hole 18 formed in the main rocker arm 1 such that is fixed in the main rocker arm 1 parallel to the main rocker shaft 3.

The sub-rocker arm 2 is not in contact with the valve 9, a cam follower 23 consisting of an iron alloy being fixed on its other end which is in sliding contact with the second cam 22. The main bodies of the main rocker arm 1 and sub-rocker arm 2 are constructed of aluminum or am aluminum alloy.

A lifter 41 and spring 25 are housed in a hole formed in the main rocker arm so that the sub-rocker arm 2 follows the second cam 22. The spring 25 is supported by a retainer 48 inserted underneath the hole, mid it elastically pushes the lifter 41 toward the sub-rocker arm 2. The lifter 41 is supported by a support surface 47 formed in the hole such that the lifter is free to slide.

A prop 31 is provided for transmitting the elastic force of the spring 25 to the sub-rocker arm 2. The prop 31 comprises a cylindrical member 53 which engages with a horizontal guide groove 32 formed in the sub-rocker arm 2 via splines 67, and a first and second leg 51, 52 which project downwards from this cylindrical member 53. The prop 31 is prevented from rotating relative to the sub-rocker arm 2 by the splines 67, while it is supported free to slide parallel to the rocker shafts 3 and 16.

A ring-shaped contact piece 40 is fitted in the main rocker arm 1 in a position such that it surrounds the lifter 41. This contact piece 40 having a male screw 49 on its outer surface is screwed into a hole 50 formed in the main rocker arm 1.

Figure 6:
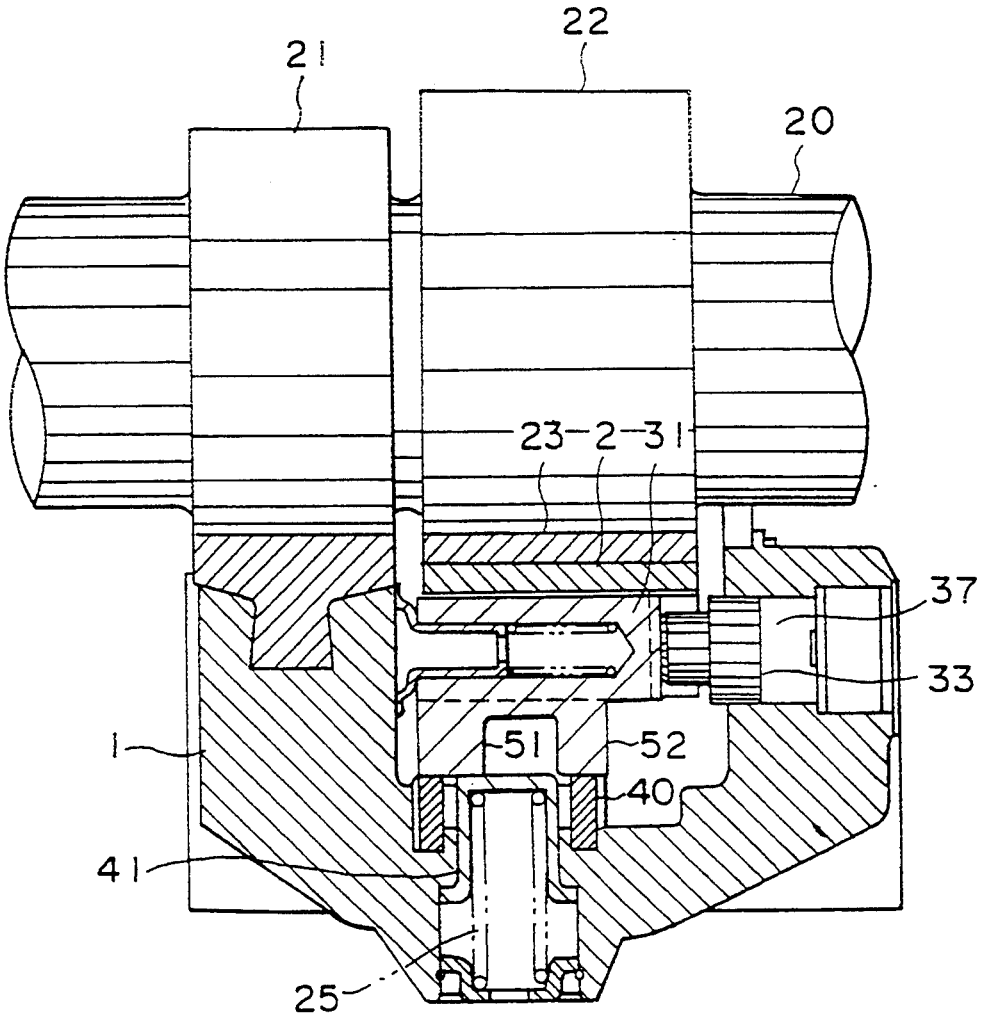
FIG. 6 is similar to FIG. 3, but showing the cam change-over mechanism in another change-over position.

By applying a force in an axial direction to the cylindrical member 53, the prop 31 is caused to slide between a contact position wherein the first and second legs 51, 52 are in contact with the upper edge of the contact piece 40 as shown in FIG. 6, and a non-contact position wherein neither of the legs is in contact with the contact piece 40 but the first leg 51 is in contact with the lifter 41 as shown in FIG. 3.

The dimensions of the legs are determined such that the second leg 52 touches the contact piece 40 before the first leg 51, when the prop 31 is displaced from the non-contact position to the contact position. As the contact position of the contact piece 40 with the second leg 52 is closer than its contact position with the first leg 51 to the center line of the second cam 22, the eccentricity of the transmission path of the force acting from the second cam 22 to the main rocker arm 1 with respect to the second cam 22, can be reduced.

A plunger 33 is supported in the main rocker arm 1 which acts as a means for driving the prop 31 between the contact position and non-contact position with the contact piece 40. For this purpose, a hole 35 which accommodates the plunger 33 such that it is free to slide is formed horizontally in the main rocker arm 1. An oil pressure chamber 37 is formed behind the plunger 33 by closing one side of this hole 35 by a plug 39.

A hole 59 is formed in an axial direction in the cylindrical member 53 of the prop 31, a return spring 38 which maintains the prop 31 in contact with the plunger 33 being housed in this hole 59. The return spring 38 is supported by a spring stopper 34 inserted such that it is free to slide in the hole 59. The base of the spring stopper 34 is in sliding contact with a support surface 58 formed in the main rocker arm 1.

The plunger 33 drives the prop 31 in a horizontal direction against the force of the return spring 38 from the non-contact position to the contact position according to the oil pressure supplied to the oil chamber 37, and the prop 31 is displaced in the reverse direction when the pressure of the oil chamber 37 is released.

Figure 5:
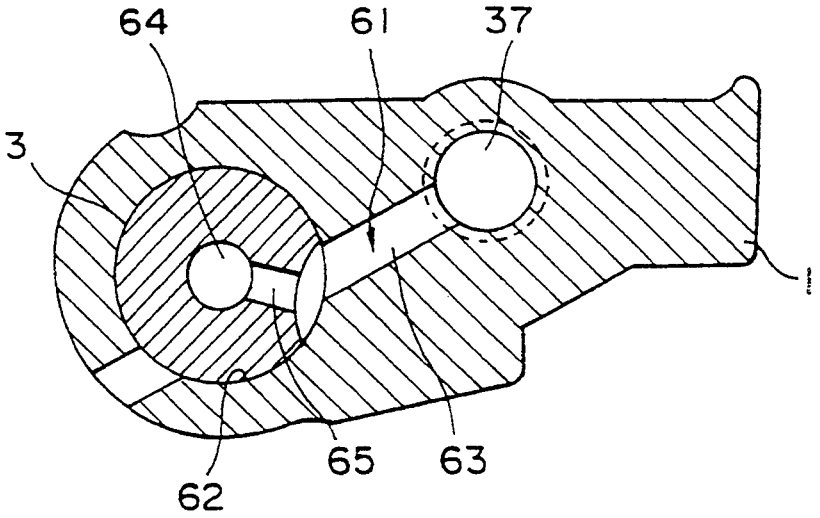
FIG. 5 is a sectional view through the cam change-over mechanism along a line 5—5 of FIG. 2.

As shown in FIG. 5, in the oil chamber 37, oil pressure is supplied via an oil passage 61 which passes through the main rocker shaft 3 and main rocker arm 1. This oil passage 61 comprises a throughhole 63 formed in the main rocker arm 1 which connects the oil chamber 37 and an axle hole 62 accommodating the main rocker shaft 3, an oil gallery 64 formed in an axial direction inside the rocker shaft 3, and a throughhole 65 formed in a radial direction in the main shaft 3 so as to connect the oil gallery 64 and the throughhole 63.

High pressure working oil is led under predetermined high speed running conditions to an oil gallery 64 via a change-over valve, not shown. The operation of this change-over valve is electronically controlled by a control unit. An engine speed signal, cooling water temperature signal, lubricating oil temperature signal, air oversupply pressure signal from a supercharger and an opening signal from a throttle valve are input to the control unit, this unit changing over the change-over valve according to these signals.

Due to the control of the control unit, no oil pressure is supplied to the oil chamber 37 at low engine speeds, and the plunger 33 is withdrawn as shown in FIG. 3. The prop 31 is therefore maintained in the non-contact position, i.e. the position wherein neither the first leg 51 nor the second leg 52 is in contact with the contact piece 40 as shown in FIG. 3. The second cam 22 causes the sub-rocker arm 2 to oscillate, but as the first leg 51 causes the lifter 41 to move down against the force of the spring 25, the motion of the sub-rocker arm 2 is not transmitted to the main rocker arm 1. The main rocker arm 1 therefore causes the intake valve 9 to open and close according to the motion of the first cam-which is smaller.

At high engine speeds, oil pressure is supplied to the oil chamber 37 via the oil gallery 64 and the oil passage 61 under control of the change-over valve of the control unit. Due to the oil pressure of the oil chamber 37, the plunger 33 moves the prop 31 to the contact position wherein the first leg 51 and second leg 52 are both in contact with the upper edge of the contact piece 40 against the force of the return spring 38. In this position, the motion of the sub-rocker arm 2 is directly transmitted to the main rocker arm 1 via the contact piece 40, so that the main rocker arm 1 oscillates together with the sub-rocker arm 2 according to the motion of the second cam 22 which has a larger profile. The cam follower 14 of the main rocker arm 1 regularly comes off from the first cam 21, and the intake valves 9 increase both the valve lift amount and opening time according to the profile of the second cam 22.

On the other hand, when there is a change-over from high engine speed to low engine speed, the oil pressure led to the oil chamber 37 falls, and the prop 31 moves to the non-contact position while pushing the plunger 33 back due to the elastic restoring force of the return spring 38. The sub-rocker arm 2 and main rocker arm 1 are then again able to oscillate relative to one another, and the main rocker arm 1 again opens and closes the intake valve 9 according to the profile of the first cam 21.

Since the oscillation of the sub-rocker arm 2 is transmitted to the main rocker arm 1 via the contact of the prop 31 with the contact piece 42, there is no need to provide high precision machined engaging holes in the rocker arms 1 and 2 as in the prior art. The machining of the rocker arms 1 and 2 is therefore rendered facile.

Further, as the rocker arms 1 and 2 are both constructed of aluminum or an aluminum alloy, the construction is also lightweight. However, as the prop 31, contact piece 42 and cam followers 14 and 23 are constructed of an iron alloy unlike the sub-rocker arm 2 and main rocker arm 1, the construction is fully able to withstand wear.

By making the rocker arms 1 and 2 lightweight, the ability of the rocker arms 1 and 2 to follow the second cam in the high engine speed region is enhanced. The restoring force of the valve spring 11 and the spring 25 may therefore be made small, and friction between the cams 21, 22 and the cam followers 14, 23 is reduced. This also contributes to reducing fuel consumption of the engine.

Figure 7:
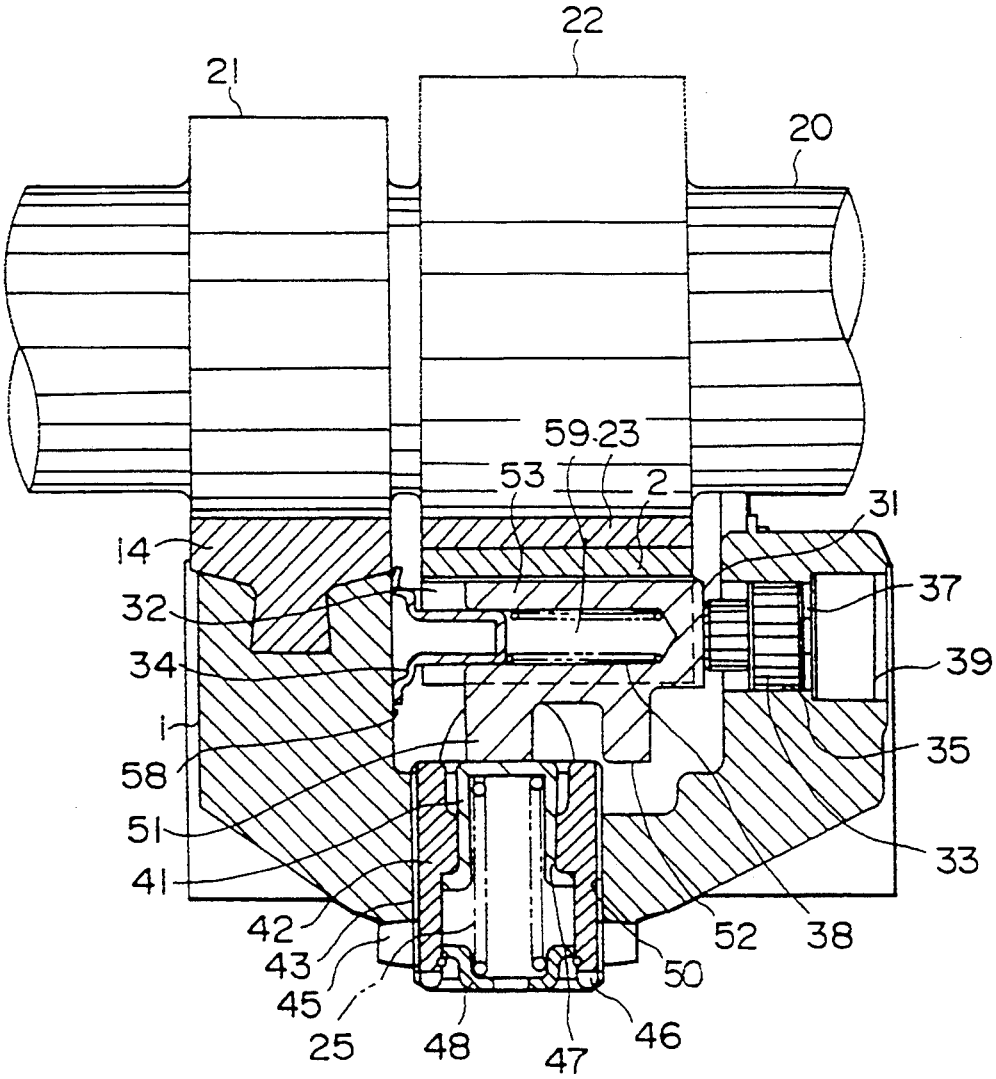
FIG. 7 is similar to FIG. 3, but showing another embodiment of this invention.

This invention is not limited to the aforesaid embodiment, and various design modifications could be made by those skilled in the art. For example, the spring 25 and lifter 41 may be housed in the contact piece 42 as shown in FIG. 7. The hole 50 holding the contact piece 42 is bored right through the main rocker arm 1, the length of the contact piece 42 being such that it projects from the hole 50. A lock nut 45 is screwed onto the outer circumference of the contact piece 42 projecting from the hole 50 underneath the main rocker arm 1, a groove 46 being formed on the lower edge of the contact piece 42 so as to make rotation adjustments by means of tools.

A support surface 47 supporting the lifter 41 is formed inside the contact piece 42, mid the retainer 48 is inserted underneath it.

By constructing the contact piece 42 and main rocker arm 1 in this way, the screw length of these members is longer mid the connected structure is strengthened. Further, when the drive force of the second cam 22 is transmitted to the main rocker arm 1 via the contact piece 42, the stress arising in the screw part on the circumference of the contact piece 42 and the hole 50 is reduced, and suitable dynamic conditions are obtained.

Further, if the lock nut 45 is loosened and the groove 46 is rotated, the height of the contact piece 42 may be adjusted from outside. The relative oscillation positions of the sub-rocker arm 2 and main rocker arm 1 in the contact position can therefore be adjusted, and adjustment of cam clearance is facile. It is thus possible to further reduce machining precision of the rocker arms 1 and 2 so that manufacture is further simplified.

This invention may also be applied to a change-over mechanism involving three or more cams.

The embodiments of this invention in which an exclusive property or privilege is claimed are defined as follows:

1. A cam change-over mechanism for an engine, comprising:

a valve, a first cam which opens and closes said valve, a second cam larger than said first cam which opens and closes said valve, a main rocker shaft supported on the engine, a main rocker arm supported free to rotate on the main rocker shaft, said main rocker arm being driven by said first cam so as to transmit the motion of said first cam to said valve, a sub-rocker shaft supported on said main rocker arm such that it is parallel to said main rocker shaft, a sub-rocker arm supported on said sub-rocker shaft such that it is free to rotate, means for elastically maintaining said sub-rocker arm in contact with said second cam, a sliding member provided on said sub-rocker arm such that it slides parallel to said sub-rocker shaft, a contact piece supported on said main rocker arm in contact with said sliding member in a predetermined slide position, and means for driving said sliding member between a position wherein it is in contact and a position wherein it is not in contact with said contact piece, wherein said sliding member and said contact piece are constructed of iron or an iron alloy, and said main rocker arm is constructed of aluminum or an aluminum alloy.

2. A cam change-over mechanism as defined in claim 1, wherein said contact piece is formed in a cylindrical shape, having an outer circumference in the form of a male screw, and said main rocker arm has a screw hole into which said contact piece screws.

3. A cam change-over mechanism as defined in claim 2, wherein said elastic maintaining mechanism comprises a spring, and a member supported by said spring which is in contact with said sliding member in its non-contact position, said elastic maintaining mechanism being housed in said contact piece.

4. A cam change-over mechanism as defined in claim 1, wherein said drive memos comprises a plunger inserted in said main rocker arm such that it is free to slide parallel to said sub-rocker shaft, a spring which maintains said sliding member in contact with said plunger, and hydraulic means which causes said plunger to slide.

5. A cain change-over mechanism as defined in claim 4, wherein said hydraulic means comprises an oil chamber formed in said main rocker arm, a hydraulic passage formed through said main rocker shaft, and a through-hole formed in said main rocker arm which connects said hydraulic passage and said oil chamber.

6. A cam change-over mechanism for an engine comprising:

an intake valve, a first cam which opens and closes said valve, a second cam larger than said first cam which opens and closes said valve, a main rocker shaft supported on the engine, a main rocker arm supported free to rotate on said main rocker shaft, said main rocker arm being driven by said first cam so as to transmit the motion of said first cam to said valve, a sub-rocker shaft supported on said main rocker arm such that it is parallel to said main rocker shaft, a sub-rocker arm supported on said sub-rocker shaft such that it is free to rotate, means for elastically maintaining said sub-rocker arm in contact with said second cam, a sliding member provided on said sub-rocker arm such that it slides parallel to said sub-rocker shaft, a contact piece supported on said main rocker arm in contact with said sliding member in a predetermined slide position, and means for driving said sliding member between a position wherein it is in contact and a position wherein it is not in contact with said contact piece, wherein said sliding member and contact piece are constructed of iron or an iron alloy, and said main rocker arm is constructed of aluminum or an aluminum alloy.

* * * * *